United States Patent [19]

Groff

[11] 4,243,361

[45] Jan. 6, 1981

[54] STANDING VALVE ASSEMBLY FOR AN OIL WELL PUMP

[75] Inventor: Henry C. Groff, Bakersfield, Calif.

[73] Assignee: Oil Extractors, Inc., Fort Worth, Tex.

[21] Appl. No.: 943,965

[22] Filed: Sep. 20, 1978

[51] Int. Cl.[3] ..... F04B 21/04; F04B 21/02

[52] U.S. Cl. ..... 417/554

[58] Field of Search ..... 417/554, 260

[56] References Cited

U.S. PATENT DOCUMENTS

| | | | |
|---|---|---|---|
| 974,342 | 11/1910 | Bell | 417/261 |
| 1,374,923 | 4/1921 | Hunt | 417/554 |
| 1,512,500 | 10/1924 | Swartz | 417/262 |
| 2,464,347 | 3/1949 | Roofe | 417/554 |
| 2,538,592 | 1/1951 | Pratt | 417/554 |
| 2,544,094 | 3/1951 | Knowles | 417/260 |
| 2,689,534 | 9/1954 | Mack | 417/554 |
| 3,076,416 | 2/1963 | Schmidt | 417/260 |
| 3,143,080 | 4/1964 | Sufliff | 417/554 |
| 3,146,725 | 9/1964 | Harris | 417/554 |
| 3,586,464 | 6/1971 | Crowe | 417/260 |
| 3,773,437 | 11/1973 | Suman | 417/554 |
| 4,049,365 | 9/1977 | Sparks | 417/554 |

*Primary Examiner*—William L. Freeh

*Attorney, Agent, or Firm*—James E. Bradley

[57] ABSTRACT

An apparatus for connection to an oil well pump to improve its performance. The oil well pump is of the type having a traveling valve located within a barrel at the end of a string of production tubing and reciprocated by a string of sucker rods in the tubing. The apparatus includes a sub connected to the lower end of the production tubing. The barrel with a pump plunger and traveling valve is attached below the sub. The sub has a central passage and several valve passages. A tube is secured to the central passage. A piston reciprocates in the tube and is connected to the sucker rods at the top and to the pump plunger below. Standing valves are secured to the tops of the valve passages to allow only upward flow, isolating the pump plunger from the production column on the downstroke.

5 Claims, 5 Drawing Figures

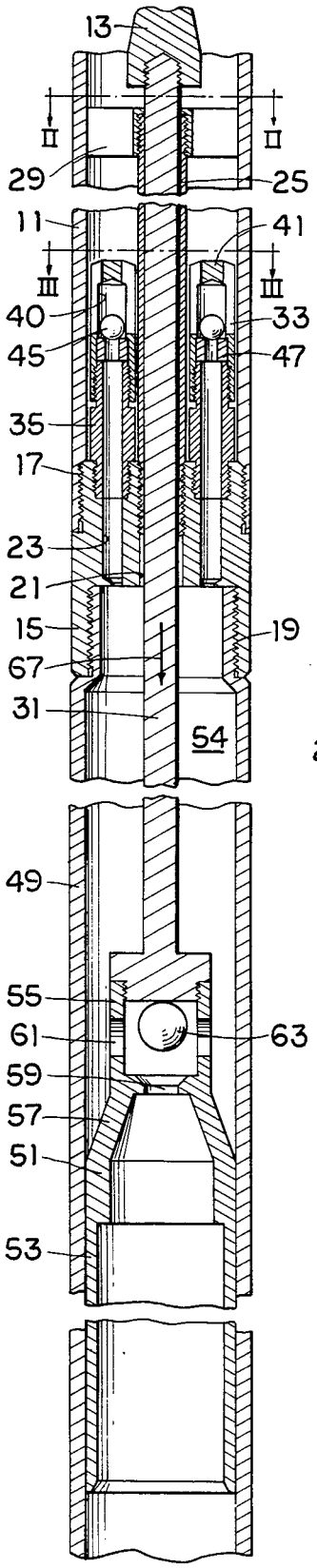
FIG. 1
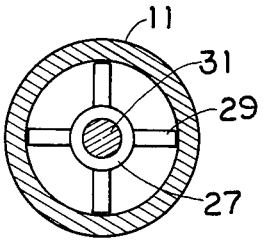
FIG. 2
FIG. 3
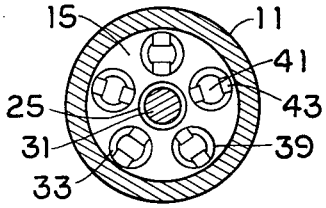
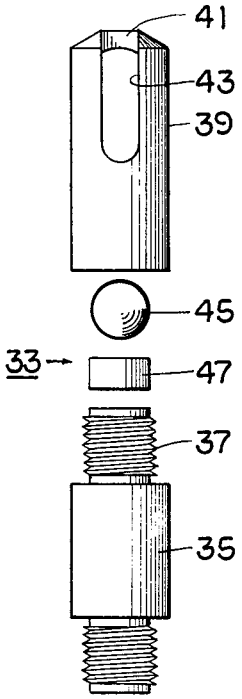
FIG. 4
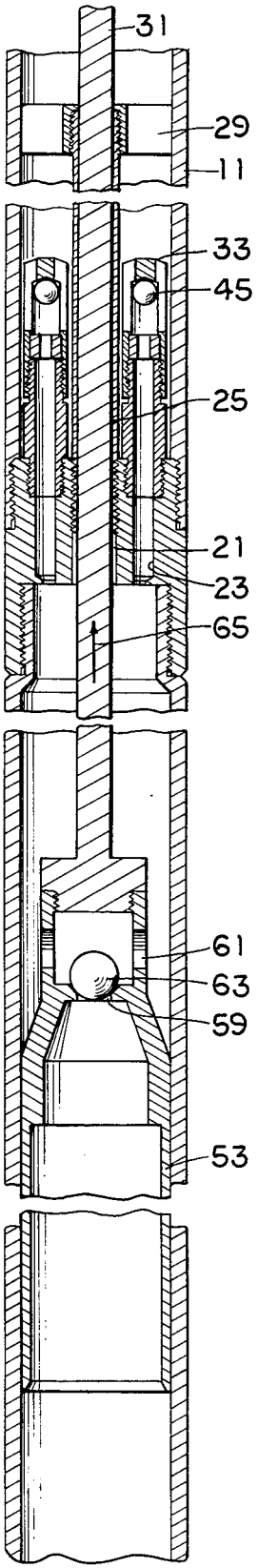
FIG. 5

STANDING VALVE ASSEMBLY FOR AN OIL WELL PUMP

BACKGROUND OF THE INVENTION

1. Field of the Invention

This invention relates in general to oil well pumps and in particular to an improved standing valve assembly for a pump actuated by sucker rod.

2. Description of the Prior Art

In U.S. Pat. No. 3,143,080, all of which material is hereby incorporated by reference, an apparatus for improving the performance of a reciprocating oil well pump is disclosed. The pump is of the type having a plunger and traveling valve reciprocally carried in a cylindrical barrel at the bottom of the string of production tubing. The plunger is reciprocated by a string of sucker rod, pumping fluid on each upstroke.

A standing valve assembly is mounted above the plunger. The standing valve assembly includes a sub having a bore through which a piston is reciprocally carried. The piston connects the plunger to the sucker rod. The sub also has bores into which ball valves are secured. The valves in the sub close on the downstroke of the plunger, isolating the fluid in the production tubing from the plunger. The weight of the sucker rods and hydrostatic force on the piston urge the plunger downward. On the upstroke, the standing valves in the sub open to allow fluid pushed upward from the barrel to enter the column of fluid in the production tubing. The standing valves speed up the downstroke, increasing the performance of the pump.

Improvements to the apparatus shown in the above patent are desirable, however. The pumps manufactured under the above patent utilized resilient seals between the piston and the sub. Longer lasting and more effective sealing between the piston and sub are desirable. The standing valves mounted in the sub provided only a small area of fluid to pass upward. It is desirable to reduce fluid resistance through the standing valves by increasing the area through which the fluid can pass.

SUMMARY OF THE INVENTION

It is the general object to provide an improved reciprocating oil well pump.

It is the further object to provide an improved standing valve assembly above the reciprocating pump means having longer lasting and more effective sealing between the piston and sub.

It is the further object to provide an improved standing valve assembly above the reciprocating pump means having standing valves that provide less resistance to fluid flow.

In accordance with these objects, a standing valve assembly is provided for use with reciprocating plunger pumps. The standing valve assembly is mounted to a sub above the plunger. A metal tube is secured to the top of the sub. The piston sealingly and slidingly fits within the metal tube, with its ends attached to the sucker rod and the plunger. The length of the tube and close fit provides superior and long lasting sealing of the production column fluid from the barrel. The tube is centralized at the top. The standing valves are mounted to the top of the sub. Each standing valve includes a housing within a bore containing a ball and seat ring. The housing has sidewalls and slots for allowing the egress of fluid pushed upward from the barrel. The elongated slots provide an unrestricted area in excess of the inner diameter of the seat ring.

BRIEF DESCRIPTION OF THE DRAWING

FIG. 1 is a vertical sectional view of a pump constructed in accordance with the teachings of this invention, shown in the downstroke position.

FIG. 2 is a sectional view of the pump of FIG. 1 taken along the line II—II of FIG. 1.

FIG. 3 is a sectional view of the pump of FIG. 1 taken along the line III—III of FIG. 1.

FIG. 4 is a side elevational view, enlarged and exploded, of one of the traveling valves of the pump of FIG. 1.

FIG. 5 is a vertical sectional view of the pump of FIG. 1, shown in the upstroke position.

DESCRIPTION OF PREFERRED EMBODIMENTS

Referring to FIG. 1, the improved oil well pump is shown secured in a string of production tubing 11. The production tubing 11 is made up of sections of pipe approximately 30 feet in length, screwed together and lowered into the well. The tubing is surrounded by a metal casing (not shown), which comprises sections of pipe screwed together and cemented into the well. Normally the casing has been perforated, allowing fluid from the earth formations to enter. A string of sucker rod 13 is lowered into the tubing 11. The sucker rod 13 comprises individual sections of solid rod screwed together and suspended by pump surface equipment (not shown). The surface equipment includes a beam mounted on a fulcum. A drive mechanism reciprocates the beam to stroke the sucker rod up and down.

A sub 15 is secured by threads to the bottom of the production tubing 11. Sub 15 is a solid cylindrical member having exterior upper threads 17 for connection to the production tubing 11 and internal lower threads 19. Sub 15 has a central axial passage 21 extending therethrough that lies on the longitudinal axis of the production tubing 11. Sub 15 also has five other passages 23 extending therethrough. The passages 23 are spaced in a circular array at regular intervals to the side of and parallel with central passage 21. Central passage 21 and passages 23 are internally threaded at their tops.

A cylindrical, straight, metal tube 25, having exterior threads on both ends, is screwed into the threads of the central passage 21. Tube 25 extends upwardly along the axis of passage 21 and is at least 2 feet in length. A centralizing means including a hub 27 with four lateral members or fingers 29 is screwed to the top of tube 25, as shown also in FIG. 2. Fingers 29 are rigidly mounted to hub 27 and are of equal length. The outer ends of fingers 29 contact the inner wall of tubing 11 to maintain the tube 25 in the center of tubing 11. Production fluid is allowed to pass through the spaces between the fingers 29.

A hardened, chrome-plated, solid cylindrical rod or piston 31 is tightly but slidably carried inside the bore of tube 25. Piston 31 has threads on its top end where it is screwed to the lower end of sucker rod 13. The diameter of piston rod 31 is preferably about 0.002 inch less than the inner diameter of tube 25.

A standing valve 33 is mounted on the top of each valve passage 23. As shown in FIG. 4, each standing valve 33 includes a hollow cylinder 35 with external threads 37 on each end. Cylinder 35 is screwed into the threads of a valve passage 23. A cylindrical housing 39 is screwed to the upper threads 37 of cylinder 35. Housing 39 has an internal bore 40 (FIG. 1) and a partially closed top 41. A pair of elongated slots 43, one on each side, are formed through the side wall of housing 39, exposing the bore 40 to the exterior. A spherical metal ball 45 is loosely carried in bore 40. A ring 47 is carried in the bore 40 below ball 45. The inner diameter of ring 47 is greater in diameter than ball 45, allowing ball 45 to seat on the ring to prevent downward passage of fluid. The outer diameter of ring 47 is greater than the inner diameter of cylinder 35 so that it rests on top of threads 37. The length of slot 43 is greater than the diameter of ball 45 to allow fluid to pass through the slots when the ball is pushed up into contact with top 41.

So as to not restrict fluid flowing through the valve passages 23, the width, length, and number of slots 43 are selected to provide a total unrestricted area in excess of the area of the inner diameter of ring 47. Unrestricted area refers to the area below the ball when it is in contact with top 41, as shown in FIG. 5. Top 41 serves to retain the ball 45 in bore 40 and to limit its upward travel.

Referring again to FIG. 1, a cylindrical hollow barrel 49 is secured to lower threads 19 of sub 15. Barrel 49 has openings at its bottom to allow fluid from the formation to enter. Piston 31 extends below sub 15 and is connected at its lower end to a pump plunger 51. Piston 31 may be considered to be a part of and the lowest member of the string of the sucker rod. Pump plunger 51 is a hollow member having a lower cylindrical portion 53 closely and slidingly carried in the barrel 49. The cylindrical portion 53 defines a pump chamber 54 above it.

Traveling valve means for allowing upward flow of production fluid and preventing downward flow forms a part of the plunger 51 above cylindrical portion 53. The traveling valve means include a valve cage 55, which is cylindrical and integrally connected to the larger cylindrical portion 53 by a frusto-conical neck 57. Valve cage 56 is lesser in diameter than the lower cylindrical portion 53. The valve cage has a lower port 59 in communication with the interior of cylindrical portion 53, and two upper ports 61 communicating the interior of the valve cage with pump chamber 54. A spherical ball 63 of diameter larger than ports 59, 61 is loosely carried in the valve cage 55. Ball 63 is adapted to seat on port 61 when the plunger 51 is moving upward, as shown in FIG. 1. Ball 63 unseats, as shown in FIG. 1, on the downstroke.

In operation, the pump is initially submerged in a body of production fluid, with fluid being present in pump chamber 54 and in the production tubing 11. On the upstroke of sucker rod 13, as indicated by arrow 65 in FIG. 5, piston 31 will carry plunger 51 upward. This will cause traveling ball 63 to seat on port 59. Fluid in chamber 54 will be urged upward, unseating balls 45 in the standing valves 27. Fluid will flow through valve passages 23, cylinder 35, housing 39 and out slots 43 into the column of production field. When the upper end of the upstroke is reached, the sucker rod will begin moving downward, indicated by arrow 67 in FIG. 1. This causes the pressure in pump chamber 54 to fall below the hydrostatic pressure in the production column, closing standing valves 33. Ball 63 in the traveling valve unseats, allowing fluid from below to enter the pump chamber 54 as the plunger moves downward. The weight of the sucker rod and hydrostatic pressure acting on piston 31 facilitate the downward movement of the plunger. At the conclusion of the downstroke the cycle is repeated.

It should be apparent that an invention having significant advantages has been provided. The improved standing valve assembly utilizes an efficient seal formed by the piston 31 and tube 25. The length of tube 25 prevents leakage of fluid from the production tubing into the pump chamber on the downstroke. The metal to metal sealing provides long and maintenance free life. Locating the standing valves at the top of the sub rather than within bores in the sub, allows fluid to flow out through side wall slots. This reduces the restriction on the flow, providing better performance.

While the invention has been shown in only one of its forms, it should be apparent to those skilled in the art that it is not so limited but is suceptible to various changes and modifications without departing from the spirit thereof.

I claim:

1. An improved apparatus for use with a well pump, the pump being of the type having reciprocating pump means located at the end of a string of production tubing and actuated by a sucker rod within the tubing, the apparatus comprising in combination:

a sub connected to and closing the lower end of the tubing to confine a column of production fluid therein; the sub having a first passage extending axially through the center of the sub and a second passage to the side of and parallel to the first passage;

a single straight metal tube of single-piece construction secured to the sub and extending away from the first passage in alignment with the first passage;

a piston closely and reciprocally received in the tube, the upper end of the piston being connected to the sucker rod for reciprocating the piston in the tube, the lower end of the piston being connected to the pump means for reciprocating the pump means in unison with the piston; the dimensions of the piston and tube being selected so as to seal the hydrostatic pressure resulting from the column of production fluid; and standing valve means in communication with the second passage for permitting upward flow of production fluid during upstroke of the pump means through the second passage and into the tubing, but preventing reverse flow therethrough during downstroke of the pump means; and centralizer means secured to the tube above the sub and in contact with the production tubing to maintain it in the center of the production tubing.

2. An improved oil well pump for attachment to the end of a string of production tubing and activated by a sucker rod within the tubing, comprising in combination;

a sub connected to and closing the lower end of the tubing to confine a column of production fluid therein, the sub having a first passage extending axially through the center of the sub and a plurality of second passages on the side of and parallel to the first passage;

a single straight metal tube of single-piece construction secured to the top of the first passage and extending upwardly along the axis of the sub;

centralizer means above the sub and in contact with the production tubing for maintaining the tube in the center of the production tubing;

a piston of length greater than the tube closely and reciprocally received in the tube, the upper end of the piston being connected to the sucker rod for reciprocating the piston in the tube; the dimensions of the piston and tube being selected so as to seal the hydrostatic pressure resulting from the column of production fluid;

a barrel secured to the lower end of the sub;

a plunger slidable in the barrel and connected to the lower end of the piston for reciprocal movement in unison with the piston; the plunger having a passage communicating production fluid below the plunger with production fluid above the plunger;

traveling valve means in the passage of the plunger for allowing upward flow of production fluid but preventing downward flow; and a standing valve housing mounted to the top of each second passage, each housing having an axial bore, a side wall, and slots extending through the side wall;

a seat located in the bore; and a ball carried in the bore above the seat, the ball seating in the seat to prevent downward production fluid flow, and unseating when the pressure in the production fluid column to allow fluid from the barrel to flow through the second passages, bore and slots into the production tubing.

3. The apparatus according to claim 2 wherein the tube is at least 2 feet in length.

4. The apparatus according to claim 2 wherein the centralizer comprises:

a hub secured to the top of the tube; and a plurality of lateral members extending laterally outward, the lateral members being equal in length and contacting the inner wall of the production tubing to maintain the tube in the center of the production tubing.

5. The apparatus according to claim 2 wherein the slots are elongated, with lengths that exceed the diameter of the ball; the width, length and number of the slots being selected so as to provide a total unrestricted area in excess of the area defined by the inner diameter of the ring.

* * * * *